United States Patent [19]

Cox

[11] 4,265,184

[45] May 5, 1981

[54] METAL CORNERBOARD FOR PALLETS

[76] Inventor: Clayton E. Cox, 1371 Eureka Canyon Rd., Watsonville, Calif. 95076

[21] Appl. No.: 77,345

[22] Filed: Sep. 20, 1979

[51] Int. Cl.[3] ..... B65D 19/44

[52] U.S. Cl. ..... 108/55.1; 206/453; 206/586; 206/597

[58] Field of Search ..... 108/55.1, 53.1, 53.5, 108/56.1, 55.3, 55.5; 248/188.2; 211/208, 207, 190, 191; 206/386, 600, 597, 453, 586

[56] References Cited

U.S. PATENT DOCUMENTS

| | | | |
|---|---|---|---|
| 2,935,210 | 5/1960 | Cohen | 211/208 X |
| 3,901,611 | 8/1975 | Simonsen | 211/191 X |

FOREIGN PATENT DOCUMENTS

| | | | |
|---|---|---|---|
| 1602577 | 12/1970 | Fed. Rep. of Germany | 211/190 |
| 2159650 | 7/1972 | Fed. Rep. of Germany | 108/53.1 |
| 163980 | 7/1958 | Sweden | 108/53.5 |
| 708243 | 5/1954 | United Kingdom | 108/55.1 |
| 1248375 | 9/1971 | United Kingdom | 108/53.5 |

*Primary Examiner*—William E. Lyddane
*Attorney, Agent, or Firm*—Robert G. Slick

[57] ABSTRACT

An improved cornerboard for a pallet is provided wherein the main portion consists of two L-shaped metal sections with complementary tongues and slots so that the cornerboard height can be readily adjusted. The cornerboard is easily fabricated from steel sheet sections utilizing conventional bending, stamping and welding techniques.

1 Claim, 4 Drawing Figures

METAL CORNERBOARD FOR PALLETS

SUMMARY OF THE INVENTION

Many materials, such as frozen foods, are sold in relatively small cartons and in order to handle these expeditiously, they are placed on pallets. In order that the pallets can be handled and stored it is ordinarily necessary to provide some sort of corner structure for the palleted goods to keep the goods upright and to prevent them for sliding off the pallets.

In the past, it has been universal practice to hold goods by the use of ordinary boards. Two boards are nailed together at a right angle to form a corner pair and four of such corner pairs are placed at the corners of the loaded pallet and held together with some form of strap.

The cornerboards used in the past have not been fully satisfactory, primarily in that they do not properly protect the goods on the pallet. Such boards frequently allow the goods to sag so that much merchandise is lost. Further, the boards must be assembled by hand and cut to fit the particular load which is to be placed on the pallet.

In accordance with the present invention, an improved corner structure is provided for pallets which is fabricated from steel sheets yielding a strong, yet inexpensive structure.

The cornerboards are fabricated of two main parts, each of which is L-shaped, having a complementary tongue and slot configuration so that the height of the cornerboard can easily be adjusted to suit a given load and will provide a strong loadbearing corner for the pallet load.

Preferably, the cornerboards are provided with top and bottom caps so that when a plurality of pallets are stacked together, the cornerboards support substantially all of the weight of the stacked pallets so that there is no tendency to crush the goods.

The cornerboard structure of the present invention can be easily fabricated from steel sheets utilizing conventional bending, stamping and welding techniques.

Other features and advantages of the invention will be brought out in the balance of the application.

DESCRIPTION OF THE PREFERRED EMBODIMENTS

Figure 1:
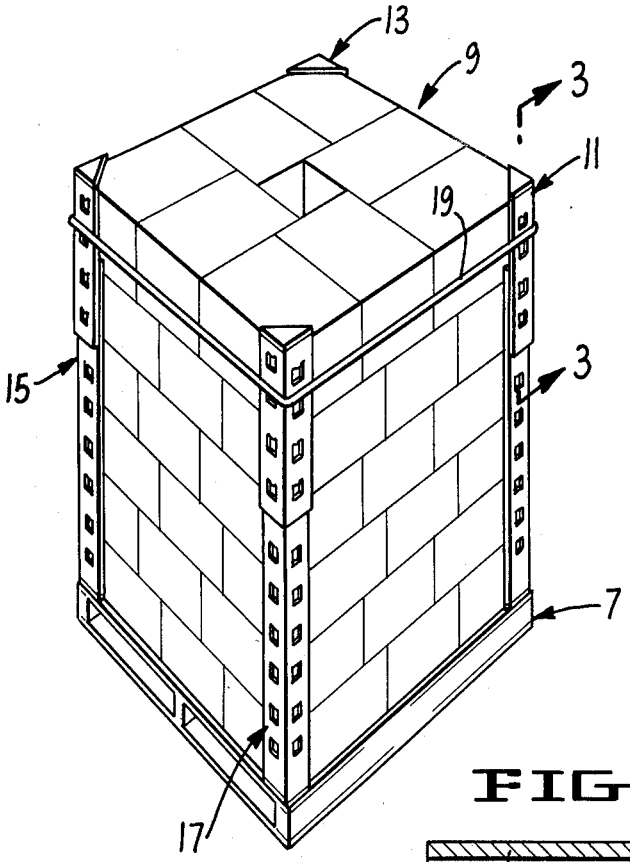
FIG. 1 is a perspective view of a loaded pallet utilizing corner structures embodying the present invention.

Referring now to the drawings by reference characters, there is shown a pallet 7 having a load of boxes 9 thereon. The boxes 9 have a rectangular configuration and have been stacked to fit the pallet 7.

In accordance with the present invention, four corner elements, generally designated 11, 13, 15, and 17, are placed at the four corners of the loaded pallet and a flexible strap 19 is employed to hold the cornerboards together and maintain the pallet load in a desired configuration. Although only a single strap 19 has been shown, in many instances two or even more straps might be used around the load.

Figure 2:
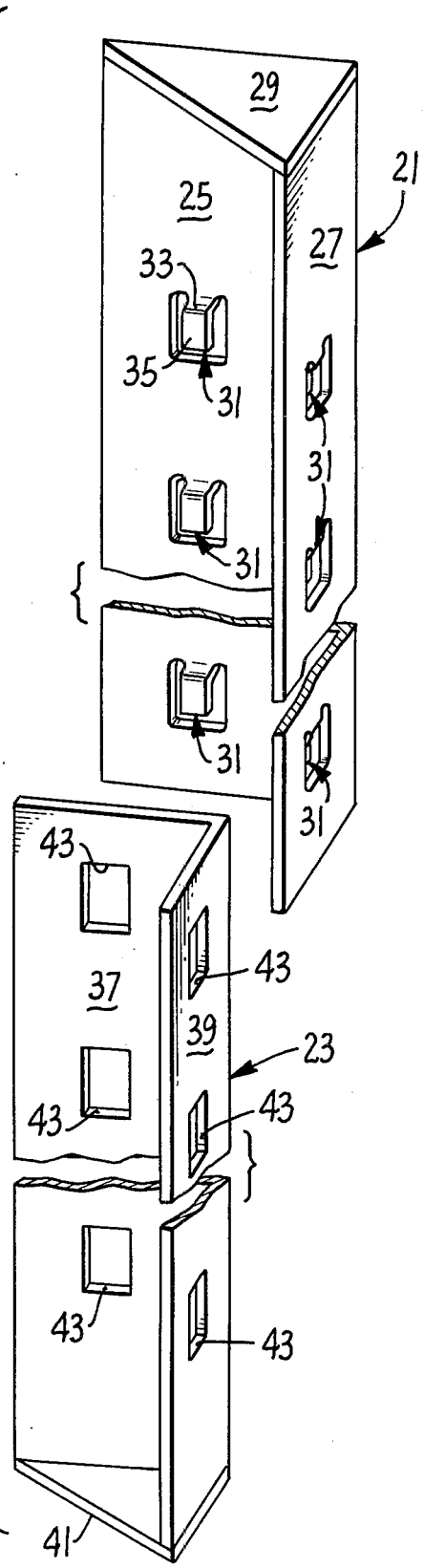
FIG. 2 is an exploded, enlarged perspective view of a cornerboard embodying the present invention.
Figure 3:
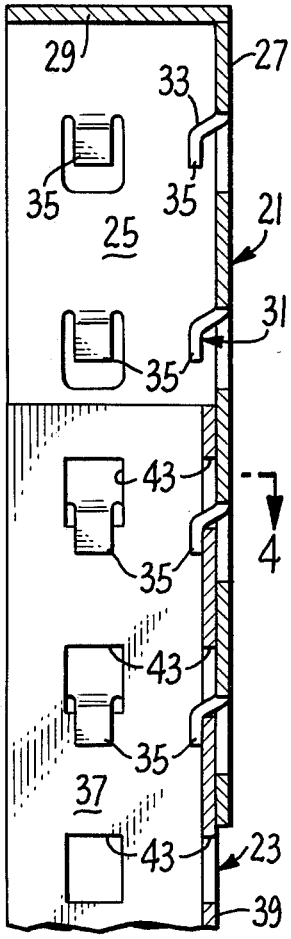
FIG. 3 is an enlarged section on the line 3—3 of FIG. 1.
Figure 4:
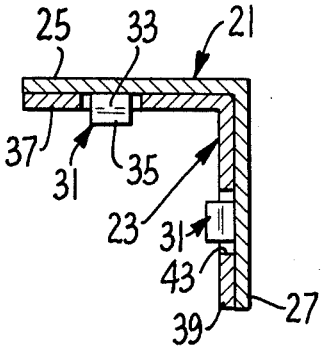
FIG. 4 is a section on line 4—4 of FIG. 3.

Since each of the cornerboards is identical, only one will be described in detail. Referring specifically to FIGS. 2 through 4, each of the cornerboards consists of an upper section, generally designated 21, and a lower section, generally designated 23. The upper section is formed, preferably by bending, of a steel sheet so that one has the walls 25 and 27 held at substantially right angles to each other. Preferably, a top cap 29 is provided which may be stamped of steel and welded onto the upper section 21. Each of the walls 25 and 27 has a series of tongues, generally designated 31, formed at regular intervals along the wall. Each of the tongues consists of a generally horizontal section 33 and a downwardly-extending tip 35. The tip 35 is formed generally parallel to the wall 27 and the space between the tip 35 and an imaginary continuation of the wall 27 is slightly greater than the thickness of the wall 27, assuming that both the upper and lower sections are made of the same gage of steel.

The bottom section 23 is of the same general configuration, having the walls 37 and 39 and a bottom plate 41 of the same general configuration as the top plate 29. The bottom section 23 is provided with a plurality of holes 43, corresponding in placement and separation to the tongues 31.

In use, it is only necessary to place the two sections in proximity to each other and to bring the upper section into contact with the lower so that the tongues 31 extend through the holes 43. Now, if one pushes downwardly slightly on the upper member, the tongues will lock into place on the bottom section as is clearly shown in FIG. 3 of the drawings.

In the foregoing description, it has been assumed that the upper and lower sections would be fabricated in such a way that a considerable range of adjustment would be possible. In some instances, the cornerboards might be fabricated to fit a certain specific load in which case the large range of adjustment would not be necessary. In fact, in its simplest form, the top member might have a single pair of tongues set at right angles thereto while the bottom section might have only a single pair of mating slots for the reception of the tongues. However, it is preferred that a plurality of tongues be formed between each of the metal sections, both from the standpoint of increased strength when more than one set of tongues is used to lock the structure and also because of the desirability of providing the adjustable feature.

Many variations can be made in the exact structure shown without departing from the spirit of this invention.

I claim:

1. A corner structure for a pallet comprising in combination:

a. a top section, said top section having two side walls disposed at right angles to each other, forming an L-shaped structure;

b. a top cap of generally triangular configuration bridging the top walls of said L-shaped structure;

c. a plurality of tongues directed inwardly from each side wall of said top section, each of said tongues terminating in a down-turned end parallel to a side wall;

d. a bottom section of the same general configuration as said top section having side walls at right angles to each other and a bottom cap bridging the lower surfaces of said side walls;

e. said lower section having a plurality of slots formed in each side wall corresponding in placement and separation to the tongues in the top section whereby said top and bottom sections can be locked together to form a pallet corner, with said tongues entering said slots and locking against the side walls of the bottom section and f. said top section and said bottom section have a plurality of tongues and slots in the respective sections, spaced vertically from each other whereby said sections can be locked together at various preselected heights to change the distance between said top and bottom caps.

* * * * *